US006764336B2

(12) United States Patent
Ma et al.

(10) Patent No.: US 6,764,336 B2
(45) Date of Patent: Jul. 20, 2004

(54) METHOD FOR FORMING AN ELECTRICAL CONNECTOR AND AN ELECTRICAL CONNECTOR OBTAINED THEREBY

(75) Inventors: Xuedong Ma, Kunsan (CN); GuangXing Shi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/335,309

(22) Filed: Dec. 30, 2002

(65) Prior Publication Data

US 2003/0100229 A1 May 29, 2003

Related U.S. Application Data

(62) Division of application No. 09/795,910, filed on Feb. 27, 2001, now Pat. No. 6,588,100.

(51) Int. Cl.[7] ..... H01R 13/58

(52) U.S. Cl. ..... 439/604; 439/606; 439/736; 439/676; 439/885

(58) Field of Search ..... 439/604–606, 439/736, 676, 885

(56) References Cited

U.S. PATENT DOCUMENTS 5,647,767 A * 7/1997 Scheer et al. ..... 439/620
6,219,913 B1 * 4/2001 Uchiyama ..... 29/883
6,368,158 B1 * 4/2002 Kan ..... 439/676
6,416,363 B1 * 7/2002 Sumiyoshi et al. ..... 439/676
6,416,364 B1 * 7/2002 Shi et al. ..... 439/680
6,453,552 B1 * 9/2002 Chavez et al. ..... 29/884

* cited by examiner

*Primary Examiner*—Truc Nguyen
(74) *Attorney, Agent, or Firm*—Wei Te Chung

(57) ABSTRACT

A contact insert subassembly (34) for a modular jack connector (200) is obtained by the following steps:

stamping a contact strip (10) to form a group of contacts (20) which are interconnected by an end carrier (11) and a middle carrier (13), the middle carrier dividing the contacts into first and second portions (21, 22);

bending the first portion into a soldering tail portion for the contacts;

subjecting the contact strip to an insert molding to form an insulative block (30) around the middle carrier (13);

cutting the end carrier and the middle carrier from the contacts; and bending the second portion to form a contacting portion for the contacts.

5 Claims, 6 Drawing Sheets

METHOD FOR FORMING AN ELECTRICAL CONNECTOR AND AN ELECTRICAL CONNECTOR OBTAINED THEREBY

CROSS REFERENCE TO PRIOR APPLICATIONS

This patent application is a division of the co-pending U.S. application Ser. No. 09/795,910, filed on Feb. 27, 2001, now U.S. Pat. No. 6,588,100.

BACKGROUND OF THE INVENTION

1. Field of the Invention

The present invention is related to a method for forming an electrical connector and an electrical connector obtained thereby. Particularly, the present invention is related to a method for forming a modular jack connector and a modular jack connector obtained thereby.

2. Description of Prior Arts

Modular jack connectors, for example, RJ-45 modular jack connectors, are widely used in computer network application. A conventional modular jack connector is formed by the following method:

a. providing a contact strip with two ends being formed with carriers and a plurality of contacts between the two carriers;

b. subjecting the strip to an insert molding to form an insulative block at a middle portion of the contacts, said insulative block dividing the contacts into first and second exposed portions;

c. stamping the first exposed portion into a contacting portion for mating with a complementary connector, and the second exposed portion into a tail portion for being soldered to a printed circuit board;

e. cutting the carriers from the contacts;

f. assembling the insulative block together with the contacts into a space defined in an insulative housing of the RJ-45 modular jack connector;

g. if necessary, a light emitting diode (LED) being mounted to the housing to indicate the connecting situation of the modular jack connector with the complementary connector; and h. enclosing the housing with a metal shell to shield the contacts from electromagnetic interference.

In the conventional method, during the insert molding, since the middle portion of the contacts, which is the most flexible part of the contacts, is subject to the high pressured molten plastics flow, the contacts may deform to deviate from their intended positions. When this happens, the signal transmitting performance of the connector is adversely affected.

Furthermore, during the bending of the first and second exposed portions to form the contacting and tail portions of the contacts, internal stress is accumulated in the contacts. Once the carriers are cut from the contacts, the contacting and tail portions may deviate from their intended positions to release the accumulated internal stress. When this happens, the contacting portion is unable to accurately mate with the complementary connector, and the tail portion is unable to accurately solder to the printed circuit board.

Hence, an electrical connector obtained by an improved method is required, which can overcome the above-mentioned defects of the current art.

BRIEF SUMMARY OF THE INVENTION

A first objective of the present invention is to provide a method for forming a modular jack connector and a modular jack connector obtained thereby, wherein contact dislocation due to impacting force acting on the contacts during insert molding a contact strip to form a contact insert subassembly can be effectively avoided.

A second objective of the present invention is to provide a method for forming a modular jack connector and a modular jack connector obtained thereby, wherein the problem of deviation of the contacting portion and soldering tail portion of the contacts from their intended positions due to release of accumulated internal stress by removal of contact strip carriers can be effectively improved.

To fulfill the above-mentioned objectives, a method for forming a contact subassembly of a modular jack connector comprises the steps of:

a. stamping a contact strip into a group of contacts which are interconnected by an end carrier and a middle carrier, said middle carrier divides the contacts into first and second portions, wherein the second portion is located between the end carrier and the middle carrier;

b. applying a bending operation to the first portion of the contacts to form a soldering tail portion for the contacts;

c. subjecting the contact strip to insert molding to form an insulative block around a middle portion of the contacts wherein an opening is defined in the insulative block, the opening receiving and exposing the middle carrier;

d. cutting the end carrier and the middle carrier from the contacts;

e. applying a bending operation to the second portion of the contacts to form a contacting portion for the contacts.

Other objects, advantages and novel features of the invention will become more apparent from the following detailed description of the present embodiment when taken in conjunction with the accompanying drawings.

DETAILED DESCRIPTION OF THE INVENTION

Figure 2:
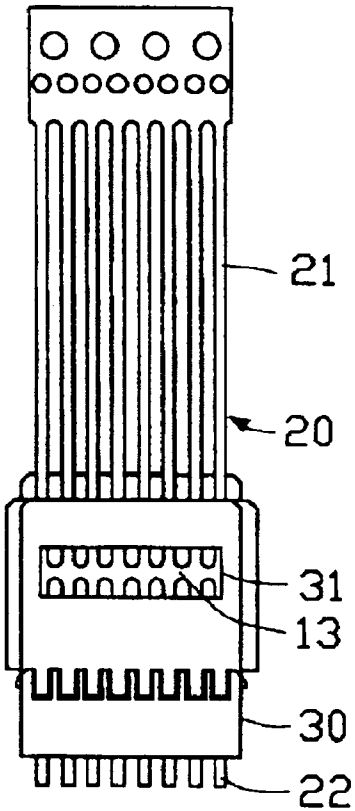
FIG. 2 is a view similar to FIG. 1 showing that the contact strip of FIG. 1 is subject to a bending operation to form a soldering tail portion and an insert molding operation to be attached with an insulative insert block.

Reference will now be made to the drawing figures to describe the present invention in detail.

Figure 1:
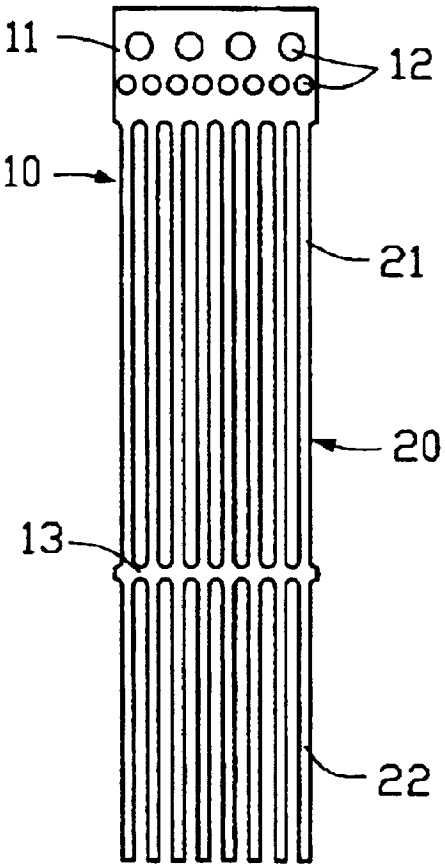
FIG. 1 is a top plan view showing a contact strip in accordance with the present invention.

Referring to FIG. 1, in order to obtain a modular jack connector 200 (see FIG. 8) in accordance with the present invention, firstly, a contact strip 10 is stamped to form a group of contacts 20. The contacts 20 are interconnected through an end carrier 11 formed at one end of the contact strip 10 and a middle carrier 13. The middle carrier 13 divides the contacts 20 into first and second portions 21, 22. The end carrier 11 defines two rows of apertures 12 therein for engaging with protrusions on a wheel of a driving mechanism (not shown) for motivating the contact strip 10 to be subject to different operations at different stations.

Figure 4:
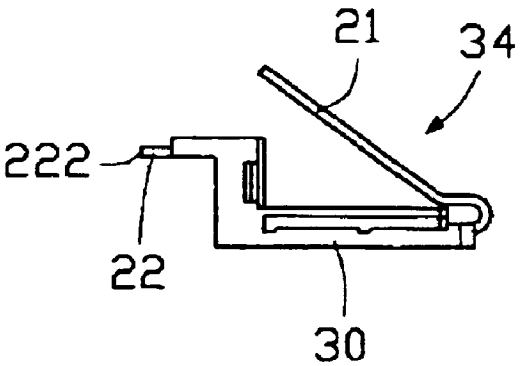
FIG. 4 is a side view showing that the contact strip of FIG. 3 is further subject to a bending operation to form a contacting portion.
Figure 3:
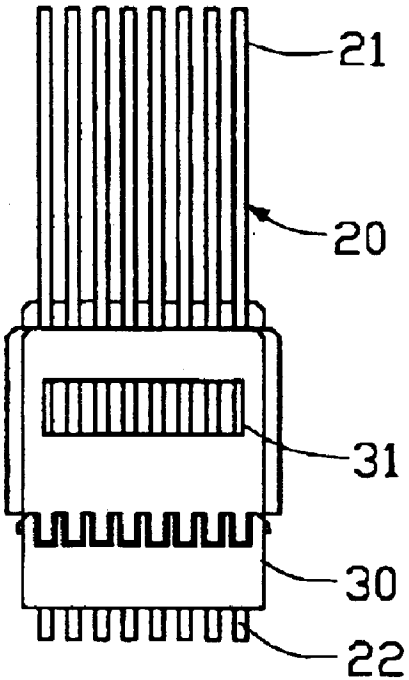
FIG. 3 is a view similar to FIG. 2 showing that a cutting operation is applied to a middle carrier and an end carrier of the contact strip of FIG. 2.
Figure 5:
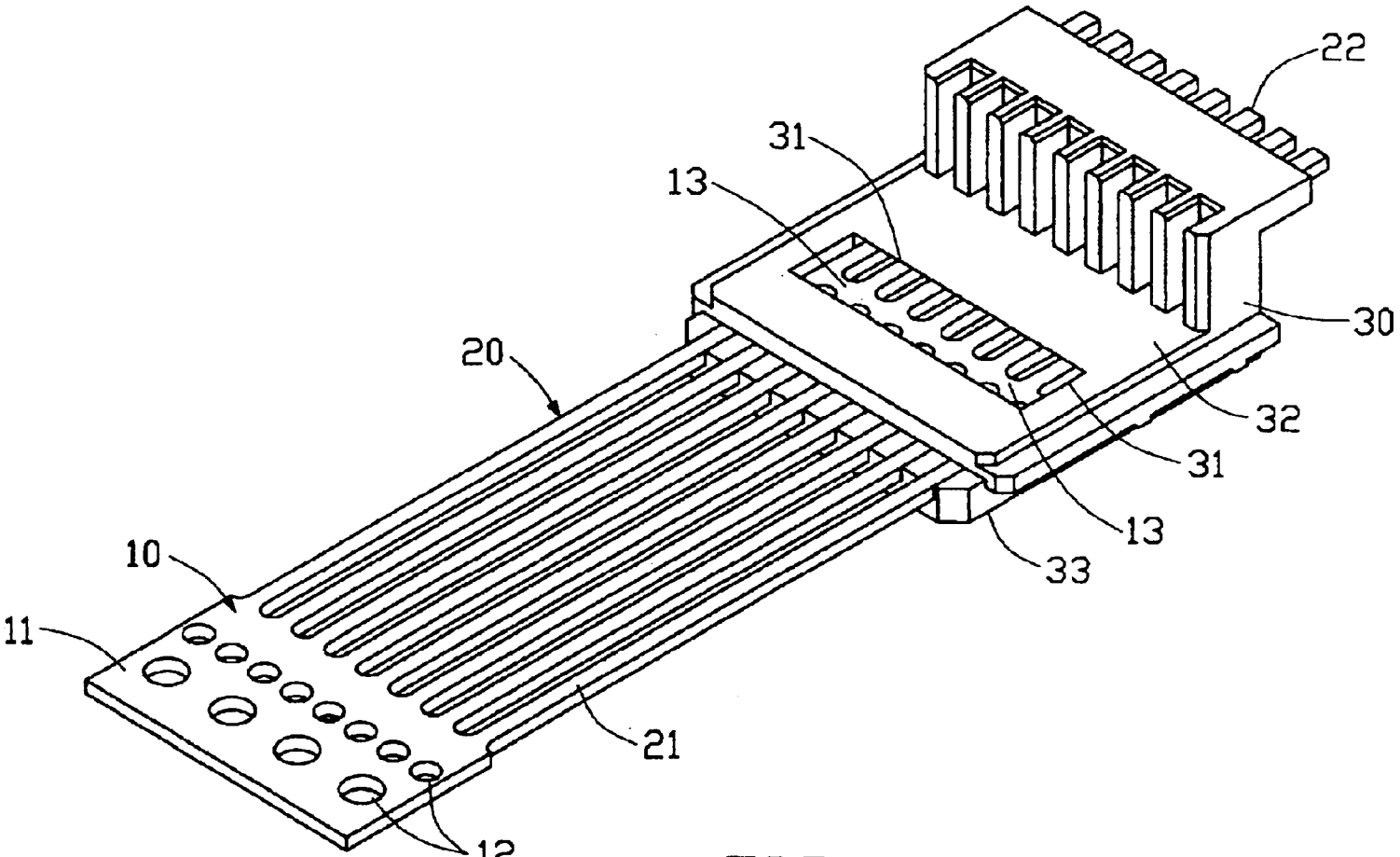
FIG. 5 is a perspective view of FIG. 2.
Figure 6:
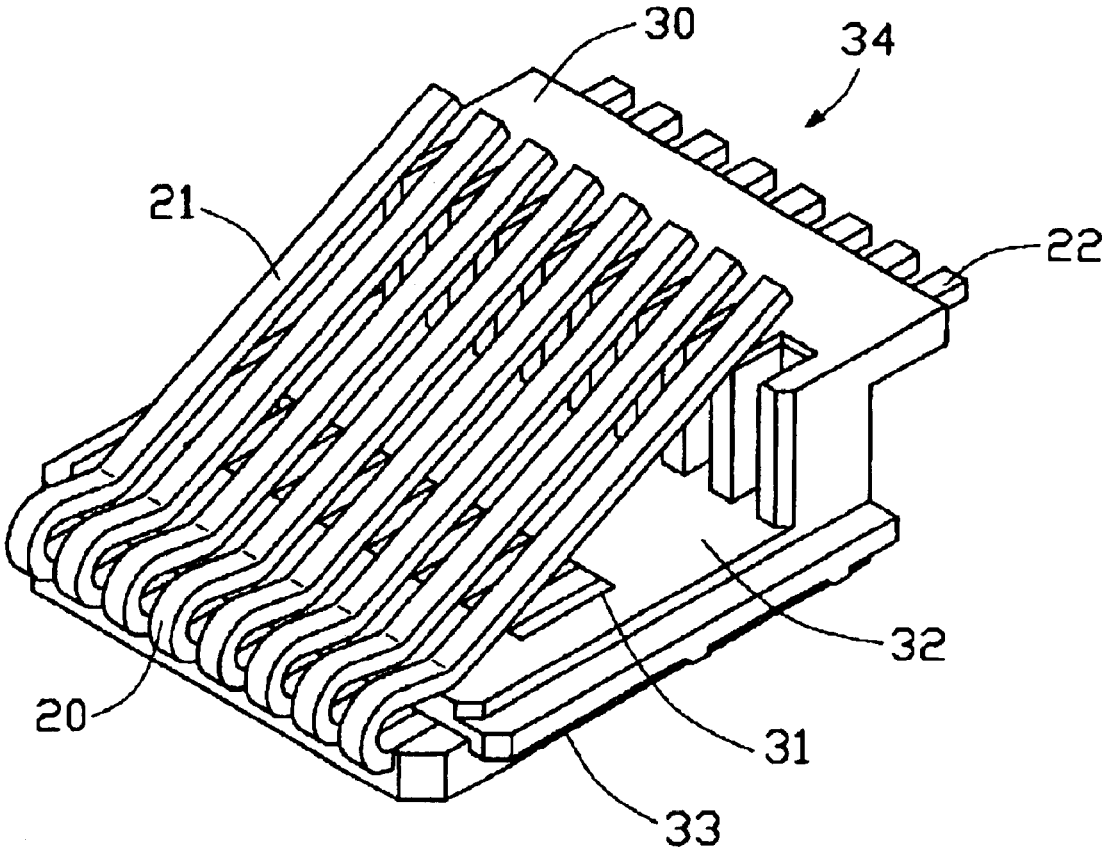
FIG. 6 is a perspective view of FIG. 4.

Then, referring to FIGS. 2 and 5, the contact strip 10 is subject to an insert molding operation to be attached with an insulative block 30 at a middle portion of the contact strip 10 after the contacts 20 is subject to a bending operation. During the bending operation, the second portion 22 of the contacts 20 is formed into a soldering tail portion 22 with a SMT (surface mounting technology) soldering end 222 being located at a level different from that the middle carrier 13 is located. As in the present invention, the most flexible middle portion of the contacts 20 is connected by the middle carrier 13, the middle portion of the contacts 20 can be correctly positioned and space from each other a suitable distance when the middle portion is subject to the high-pressured molten plastic flow during the insert molding operation. An opening 31 is defined in the insulative block 30 through an upper surface 32 and a lower surface 33 thereof. The opening 31 receives and exposes the middle carrier 13. Referring to FIG. 3, a cutting operation thereafter is applied to the end carrier 11 and the middle carrier 13 to separate the contacts 20 from each other. Finally, referring to FIGS. 4 and 6, a bending operation is applied to the first portion 21 of the contacts 20 to form a contacting portion of the contacts 20. Therefore, particularly referring to FIG. 6, a contact insert subassembly 34 is obtained.

Figure 7:
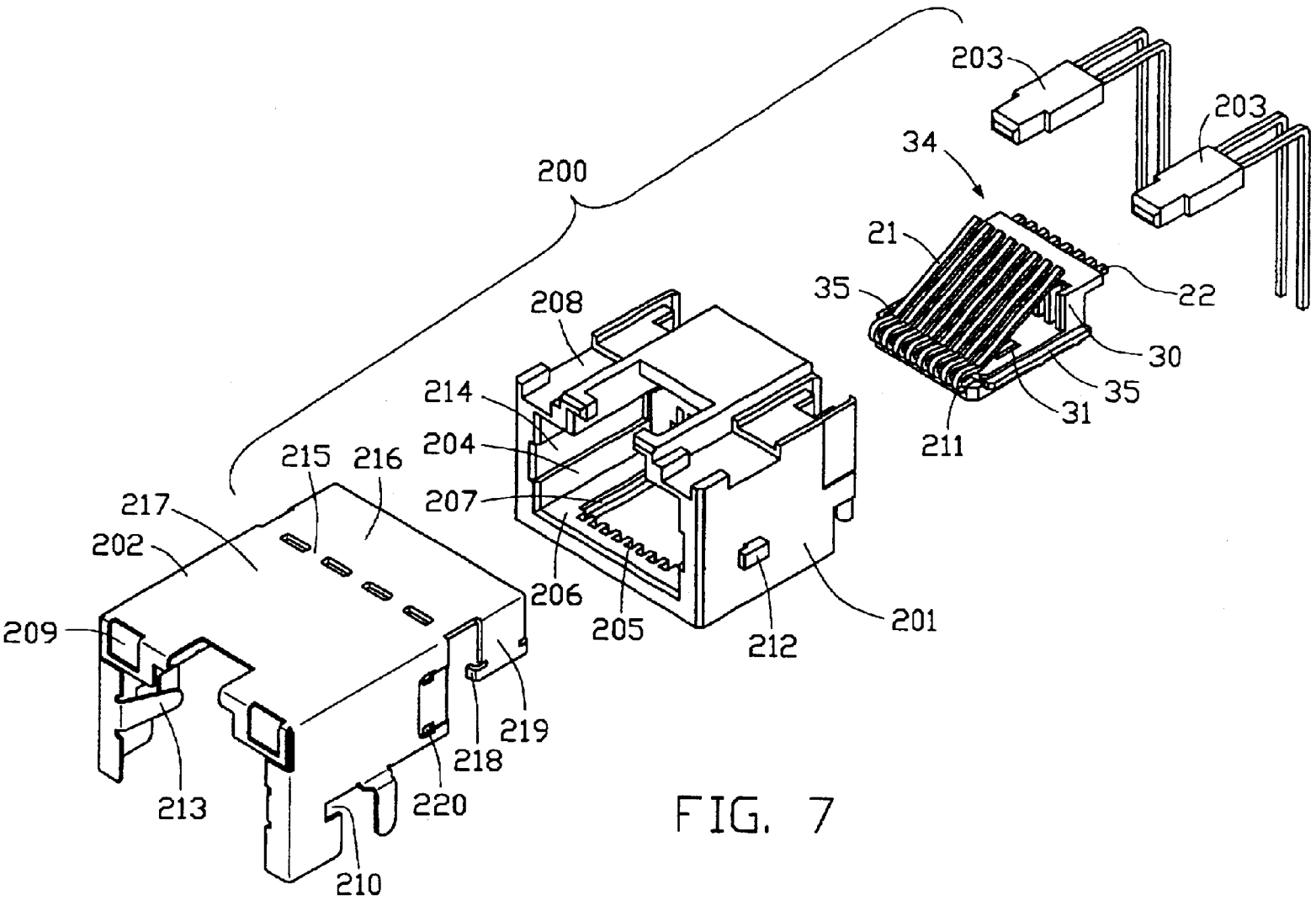
FIG. 7 is an exploded view of a modular jack connector in accordance with the present invention.
Figure 8:
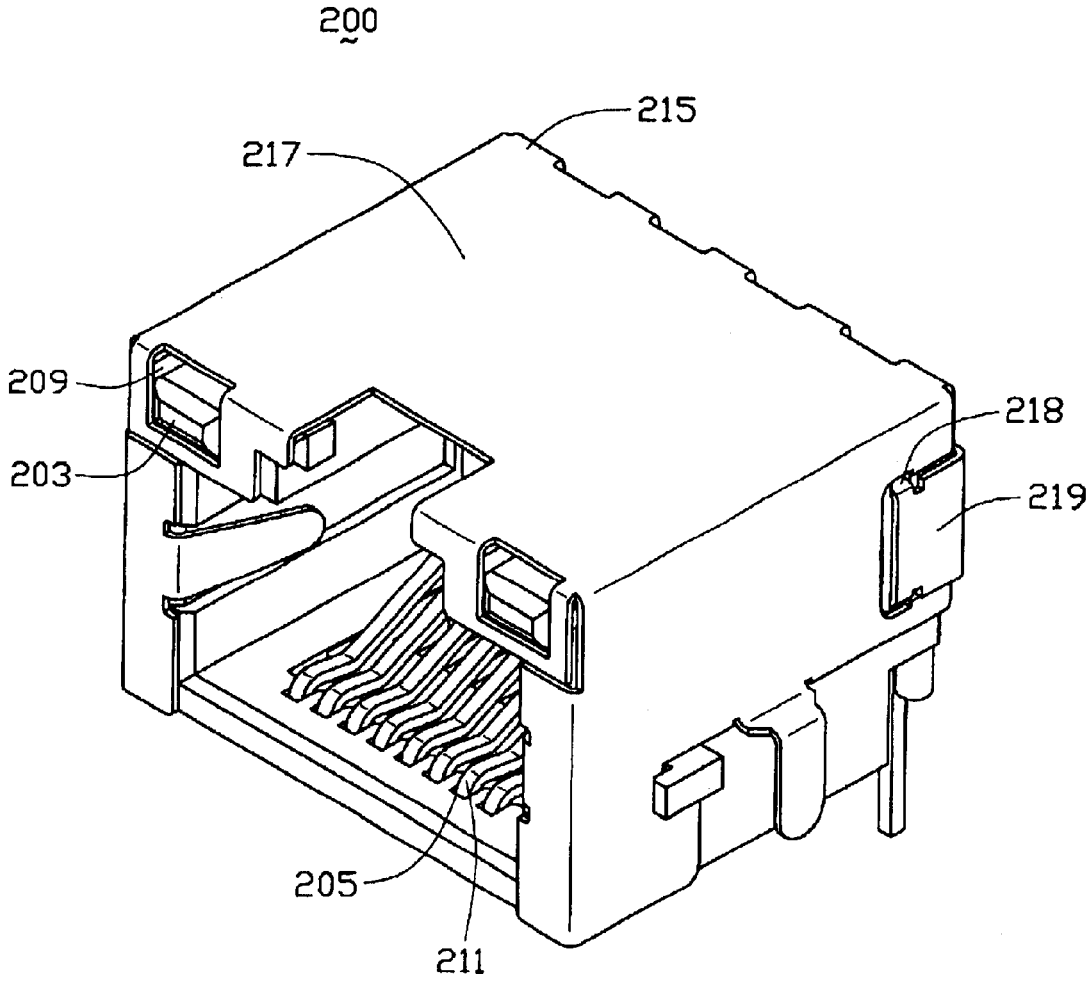
FIG. 8 is an assembled view of FIG. 7.

Referring to FIGS. 7 and 8, the modular jack connector 200 in accordance with the present invention comprises an insulative housing 201 defining a receiving space 204 for receiving the contact insert subassembly 34 obtained by the above-mentioned steps, a shield 202 for enclosing the housing 201, the contact insert subassembly 34 and a pair of light emitting diodes 203. In assembly, the contact insert subassembly 34 is inserted into the receiving space 204 from a rear side of the housing 201 to a position in which a curved section 211 of the contacting portion 21 of the contacts 20 is fitted into a corresponding depression 205 defined in a front portion of a bottom wall 206 of the housing 201, and side ribs 35 of the insulative block 30 are fitted into recesses 207 defined in the bottom wall 206 and located beside and in rear of the depression 205. The light emitting diodes 203 are then fitted into two sides of a top wall 208 of the housing 201. Finally, the shield 202 is mounted to enclose the housing 201. The shield 212 has two windows 209 through which the light emitting diodes 203 are exposed, two recesses 210 fittingly receiving two L-shaped projections 212 formed on an outer face of two side walls of the housing 201, and two grounding tabs 213 extending into the receiving space 204 and located corresponding to two grooves 214 defined in an inner face of the two side walls of the housing 201. A perforated line 215 is defined in the shield 202 between a main body 217 and a rear portion 216 of the shield 202. After the shield 202 is mounted to the housing 201, the rear portion 216 is bent relative to the main body 217 along the perforated line 215 to reach a position in which fingers 218 formed on flaps 219 of the rear portion 216 latch into holes 220 defined in side walls of the main body 217 thereby fixing the shield 202 to the housing 201, as shown in FIG. 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a receiving space;

a contact inset subassembly received in said receiving space and including:

a plurality of contacts side by side extending, along a lengthwise direction, from a rear carrier in a parallel relation and commonly insert-molded with an insulative block applied unto middle portions of said contacts, said block retainably received in the space with the associated contacts; and said middle portions of said contacts being linked with one another by a middle carrier; wherein a through opening is intentionally formed in said block to expose said middle carrier which is located in said through opening so as to allow said middle carrier to be removed after said block is formed on said contacts while before said block with the associated contacts is inserted into the space.

2. The connector as claimed in claim 1, wherein said block defines two opposite front and rear edges along said lengthwise direction, and said through opening is located between said two opposite edges.

3. The connector as claimed in claim 2, wherein said through opening extends through said block in a vertical direction perpendicular to a plane defined by said block.

4. The connector as claimed in claim 1, wherein said middle carrier extends in a lateral direction perpendicular to said lengthwise direction.

5. The connector as claimed in claim 4, wherein said through opening extends through said block in a direction perpendicular to both said lengthwise direction and said lateral direction.

* * * * *